US008206050B2

(12) United States Patent
Prague

(10) Patent No.: US 8,206,050 B2
(45) Date of Patent: Jun. 26, 2012

(54) DISPENSER HAVING AN ANTI-ROTATION PISTON

(75) Inventor: David Prague, Ringoes, NJ (US)

(73) Assignee: L'Oreal USA Products, Inc., Paris (FR)

( * ) Notice: Subject to any disclaimer, the term of this patent is extended or adjusted under 35 U.S.C. 154(b) by 1062 days.

(21) Appl. No.: 12/130,321

(22) Filed: May 30, 2008

(65) Prior Publication Data

US 2009/0297252 A1 Dec. 3, 2009

(51) Int. Cl.
*B43K 5/06* (2006.01)

(52) U.S. Cl. ..... 401/175; 401/265

(58) Field of Classification Search ..... 401/171–176, 401/261, 265

See application file for complete search history.

(56) References Cited

U.S. PATENT DOCUMENTS

| | | | | |
|---|---|---|---|---|
| 160,510 A | | 3/1921 | Gooder | |
| 1,953,296 A | * | 4/1934 | Gleeson | 401/175 |
| 4,892,427 A | * | 1/1990 | Ford | 401/182 |
| 6,039,483 A | * | 3/2000 | Szekely | 401/50 |
| 7,300,221 B2 | * | 11/2007 | Byun | 401/286 |
| 2005/0111901 A1 | | 5/2005 | Tintore Belil | |

FOREIGN PATENT DOCUMENTS

| | | |
|---|---|---|
| FR | 2483366 | 12/1981 |

* cited by examiner

*Primary Examiner* — Huyen Le

(74) *Attorney, Agent, or Firm* — Connolly Bove Lodge & Hutz LLP

(57) ABSTRACT

An elongate container includes a cylindrical chamber having an opening at one end of the container. A collar is affixed to the elongate container, and a threaded rod is axially disposed within the cylindrical chamber and coupled to the collar. The collar is adapted to rotate the threaded rod relative to the elongate container. A piston is disposed within the cylindrical chamber and is threadingly engaged with the threaded rod. The piston includes a sealing ring adapted to circumferentially seal against an inner wall of the cylindrical chamber and at least two axially aligned ribs. The ribs are disposed on a side of the piston and seated against the inner wall of the cylindrical chamber. With this arrangement, rotation of the threaded rod causes translation of the piston in the axial direction.

17 Claims, 3 Drawing Sheets

DISPENSER HAVING AN ANTI-ROTATION PISTON

BACKGROUND OF THE INVENTION

1. Field of the Invention

The field of the present invention is cosmetic product dispensers, particularly tube-style dispensers used for dispensing viscous or semi-viscous cosmetics.

2. Background

Dispensers for viscous or semi-viscous cosmetics, such as lip gloss, come in many forms, from the basic squeeze tube to mechanisms that rely on a piston and vial combination. In the latter type of dispensers, a lead screw drives and causes the piston to translate within the vial, thereby applying pressure to the bulk product within the vial and forcing the product out of the applicator head. The key to operation in these types of dispensers is to keep the piston from rotating, so that when the lead screw rotates, the piston does not rotate, but instead translates within the vial.

Various techniques have been applied to eliminate rotation of the piston as the lead screw rotates. One technique is to use an oval piston with the inside of the vial also being oval shaped. While this works, it can change the aesthetics of the package and introduce complexities in the assembly process because an oval piston must be properly oriented before it can be inserted into the oval interior of the vial. Obtaining a good seal between the oval piston and the vial can also be problematic as dimensions are harder to control on oval plastic parts due to material shrinkage.

A second technique is to increase interference between the piston seal and the inner wall of the vial. This technique can have two negative results. The first is that it increases the force needed to translate the piston via the lead screw. This leads to the necessity of applying a greater torque to the lead screw in order to dispense the product, and such a requirement may lead directly to increased consumer dissatisfaction with the dispenser and the product. The second negative impact is that the increased interference relaxes with heat and time, and sometimes to a point in which insufficient interference remains to prevent the piston from rotating.

A third technique that has been used is the addition of vertical flats or ribs running the length of the inside of the vial. Such features, however, interrupt the smoothness of the inner wall, and a smooth inner wall is preferred for creating an effective seal with the piston. Without a smooth inner wall, undesirable leakage of the product may occur within the vial. In addition the piston seals may relax against these features over time or when exposed to elevated temperatures, thereby reducing the amount of interference between the piston and the inner wall and allowing the piston to spin.

In view of the shortcomings of these known techniques, a new design for this type of dispenser is desirable, one which eliminates rotation of the piston as the lead screw rotates and overcomes one or more of these shortcomings.

SUMMARY OF THE INVENTION

The present invention is directed toward a dispenser having an anti-rotation piston. An elongate container includes a cylindrical chamber, which has an opening at one end of the container. A collar is affixed to the elongate container. A threaded rod is coupled to the collar and axially disposed within the elongate container, and the collar is adapted to rotate the threaded rod relative to the elongate container. A piston is disposed within the cylindrical chamber and is threadingly engaged with the threaded rod. The piston includes a sealing ring adapted to circumferentially seal against an inner wall of the cylindrical chamber and at least two axially aligned ribs. The ribs are disposed on a side of the piston and are seated against the inner wall of the cylindrical chamber.

Additional options may be included as part of the dispenser. In one option, two of the ribs are disposed on opposite sides of the piston. In another option, the ribs are equidistantly disposed about the side of the piston. In yet another option, multiple ribs from groups, and the groups are equidistantly disposed about the side of the piston. In yet another option, the piston may include a second sealing ring, with the ribs being disposed between the two sealing rings. In yet another option, the elongate container may include one or more clutch ribs disposed at the opening. In yet another option, the collar is incorporated as part of an applicator head. In yet another option, the collar is affixed to the elongate container at the opening. Any of the foregoing options may be implemented in combination.

Accordingly, an improved dispenser having an anti-rotation piston is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
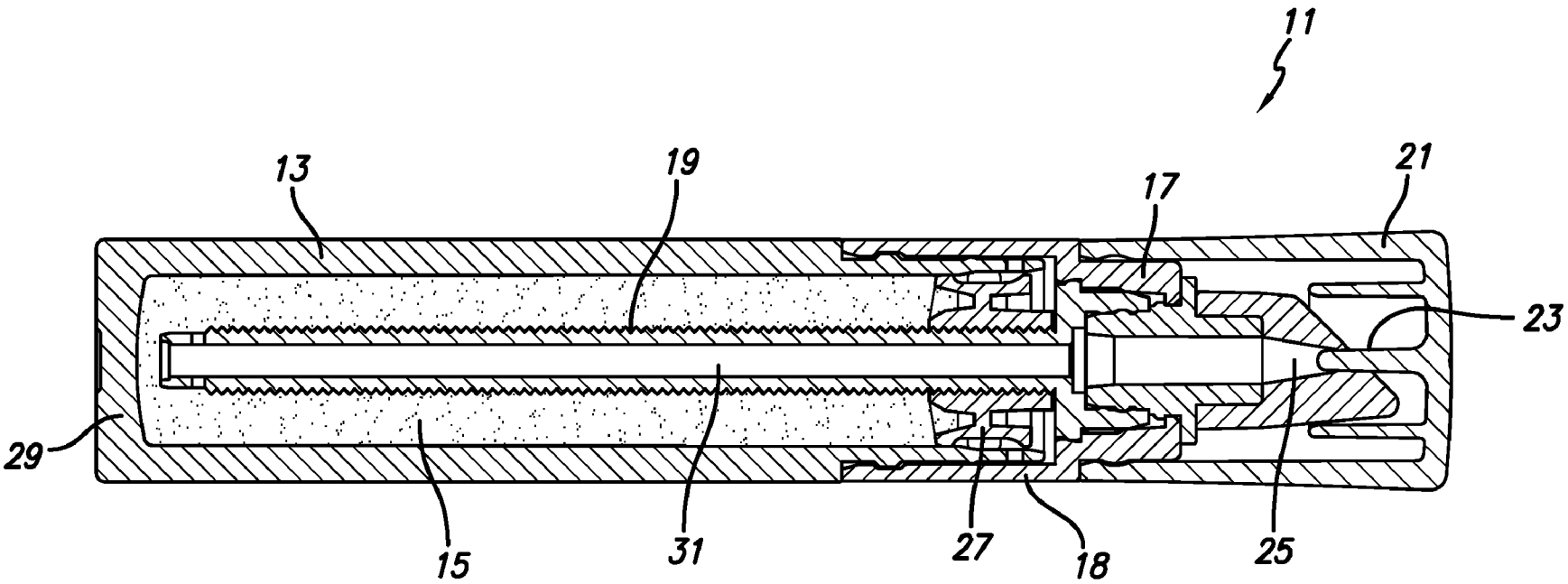
FIG. 1 is a sectional view of a cosmetics dispenser.

Turning in detail to the drawings, FIG. 1 illustrates a cosmetic dispenser 11 which is designed for use with viscous cosmetic products, although it may be used with semi-viscous and liquid products as well. The elongate container of the dispenser 11, shown in the form of a vial 13, includes a cylindrical chamber 15 from which the cosmetic product is dispensed. The cylindrical chamber 15 is open at one end, and the applicator head 17 is affixed to the open end. The mating between the applicator head 17 and the vial 13 is a snap fit connection between the vial 13 and the collar 18 integrated as part of the applicator head 17. This arrangement permits the entire applicator head 13 to rotate relative to the vial 13, by rotation of the collar 18, without being detached from the vial by the rotation motion. Such fittings are familiar to those of skill in the relevant arts and thus are not discussed in further detail. Alternatively, the applicator head may be constructed so that the collar rotates separately from the body of the applicator head, or the applicator head may be omitted entirely, with only the collar being included as part of the dispenser. As another alternative, the collar may be disposed at the closed end of the vial and disposed about a circular disk to provide structure, as opposed to being disposed about the vial.

A threaded rod 19 is coupled to the applicator head 17 and axially disposed within the cylindrical chamber 15, such that the rod 19 rotates upon rotation of the applicator head 17. Other styles of applicator heads may be used, so long as the applicator head enables rotation of the threaded rod within the cylindrical chamber. A cap 21 is placed over the applicator head 17 and includes a pin 23 which is inserted into the dispensation aperture 25 of the applicator head 17. Thus, the cap 21 aids in preventing product from being dispensed when it is in place over the applicator head 17. The cap 21 has a loose snap fit with the applicator head 17, thereby enabling easy removal of the cap 21 from the applicator head 17. Again, such snap fittings are well known to those of skill in the relevant arts.

A piston 27 is also disposed within the cylindrical chamber 15. The piston 27 engages the threads of the threaded rod 19, such that as the threaded rod 19 rotates, the piston 27 is driven toward the closed end 29 of the vial 13. This piston action forces cosmetics within the vial 13 to enter the hollow interior of the threaded rod 19, pass through a check valve 33, into the applicator head 17, and out of the dispensation aperture 25. The basic functioning of this type of cosmetics dispenser is known to those of skill in the relevant arts, and therefore is not discussed in further detail herein.

Figure 2C:
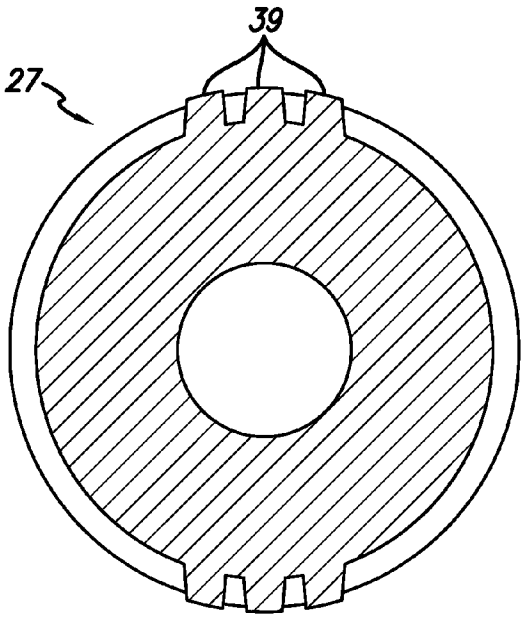
FIGS. 2A-C illustrate the piston of the dispenser of FIG. 1.
Figure 2B:
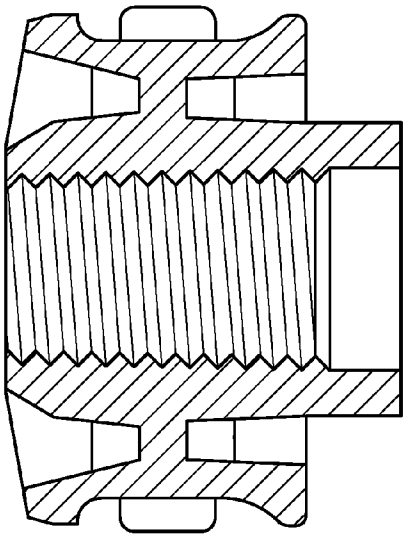
Figure 2A:
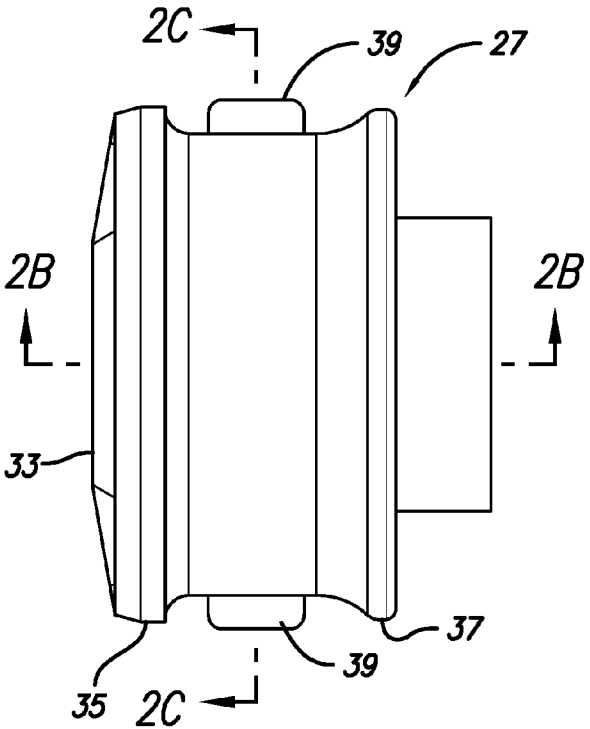

The piston 27, illustrated in FIGS. 2A-C, is translated within the vial by rotation of the threaded rod 19. The interior of the piston 27, as shown in FIG. 2B, is threaded so that the threads of the piston 27 may engage the threads of the rod 19, thereby causing the piston to translate axially as the rod 19 is rotated. The piston head 34 is sealed against the inner diameter of the container by a first sealing ring 35 positioned on one end of the piston. This first sealing ring 35 has an outer diameter which is appropriately sized according to the inner diameter of the vial to prevent seepage of the cosmetic past the sealing ring 35. The relative sizing of the sealing ring and the inner diameter of the vial, to prevent seepage, is a matter of design choice and is known to those skilled in the relevant arts. A second sealing ring 37 is included on the opposite end of the piston 27, although a single sealing ring may be sufficient for certain designs. Between the two sealing rings 35, 37, the side of the piston is constructed with a smaller overall diameter, as compared to the diameter of the piston 27 at the sealing rings 35, 37. Ribs 39 extend from the reduced diameter sidewall of the piston 27 out to just beyond the outer diameter of the sealing rings 35, 37, as shown in FIG. 2C. Three ribs 39 each are shown on opposite sides of the piston 27; however, any number of ribs may be included on each side in a grouping, with a minimum of one per side. Additionally, the ribs need not always be placed on opposite sides of the piston 27. For example, if three or more ribs or three or more rib groupings are used, the ribs or groups may be equidistantly spaced about the side of the piston 27. The spacing of the ribs, regardless of the number, is selected to apply effectively pressure distribute on the inner walls of the container about the entire circumference of the piston. Further, the ribs 39 extend out past the outer diameter of the sealing rings 35, 37, and form an effective diameter that is larger than the inner diameter ($D_2$ in FIG. 3) of the main body of the vial 13. Constructed in this manner, the ribs 39 apply sufficient pressure to the inner wall of the vial 13 to prevent the piston 27 from rotating as the threaded rod 19 rotates during use, but not so much pressure so as to substantially increase resistance of the piston 27 to axial translation within the cylindrical chamber.

Figure 3:
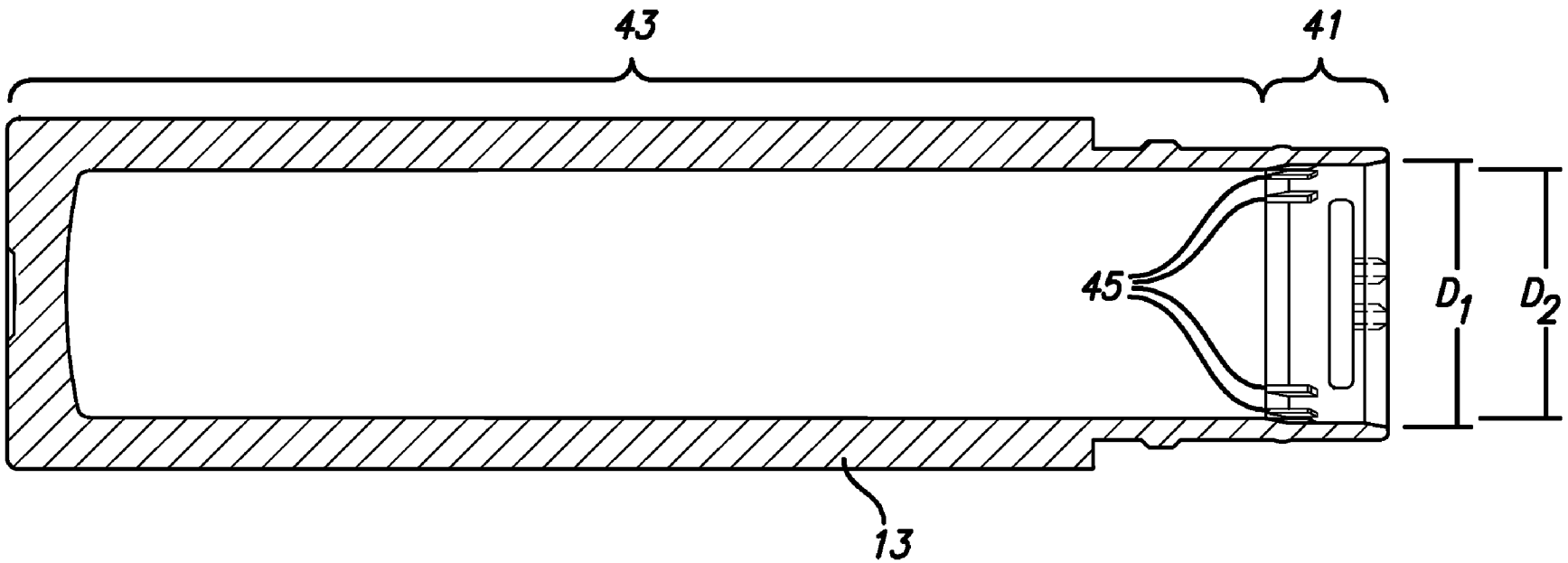
FIG. 3 illustrates the vial of the dispenser of FIG. 1.

As shown in FIG. 3, the upper neck portion 41 of the vial 13 has a slightly larger inner diameter, $D_1$, than the inner diameter, $D_2$, of the main body 43 of the vial 13. The main body 43 of the vial 43 has a circular configuration, and is devoid of ribs along its length. The enlarged inner diameter, $D_1$, of the upper neck portion 41 facilitates insertion of the piston into the vial 13 during assembly. However, while the piston is disposed within the neck portion 41 of the vial 13, the ribs on the sides of the piston may not necessarily generate sufficient force against the inner wall of the vial 13 to prevent the piston from rotating upon initial use. A plurality of guide ribs 45 are therefore included in the neck 41 of the vial 13. These guide ribs 45 engage the ribs on the piston and prevent the piston from rotating during initial use. Any number of guide ribs may be included within the neck of the vial, where even a single guide rib will suffice to prevent the piston from rotating upon initial use. The effective inner diameter formed by the guide ribs 45 is the same as the inner diameter, $D_2$, of the main body 43 of the vial 13.

Thus, a dispenser having an anti-rotation piston is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A dispenser comprising:

an elongate container including a cylindrical chamber, the cylindrical chamber having an opening at one end of the container and two guide ribs disposed at and on opposite sides of the opening;

an applicator head including a dispensation aperture and being affixed to the elongate container at the opening;

a threaded rod having a hollow interior, the threaded rod being axially disposed within the cylindrical chamber and affixed to the applicator head, wherein the applicator head is adapted to rotate the threaded rod relative to the elongate container, and the interior of the rod fluidically couples the cylindrical chamber to the dispensation opening; and a piston disposed within the cylindrical chamber and threadingly engaged with the threaded rod, wherein the piston includes a sealing ring positioned on an end of the piston, to circumferentially seal against an inner wall of the cylindrical chamber and a plurality of axially aligned ribs, extending beyond the outer diameter of the sealing ring, the ribs being disposed on a side of the piston and seated against the inner wall of the cylindrical chamber, with at least two of the ribs being disposed on opposite sides of the piston, and wherein rotation of the threaded rod causes translation of the piston in the axial direction.

2. The dispenser of claim 1, wherein the sealing ring is disposed about a head of the piston.

3. The dispenser of claim 1, wherein the ribs are equidistantly disposed about the side of the piston.

4. The dispenser of claim 1, wherein multiple ribs form groups, and the groups are equidistantly disposed about the side of the piston.

5. The dispenser of claim 1, wherein the piston includes a second sealing ring adapted to circumferentially seal against the inner wall of the cylindrical chamber, wherein the ribs are disposed between the two sealing rings.

6. The dispenser of claim 5, wherein the ribs extend beyond the outer diameter of the second sealing ring.

7. A dispenser comprising:

an elongate container including a cylindrical chamber, the cylindrical chamber having an opening at one end of the container, wherein the elongate container includes at least one guide rib disposed at the opening;

a collar affixed to the elongate container, the collar being adapted to rotate relative to the elongate container;

a threaded rod having a hollow interior, the threaded rod being axially disposed within the cylindrical chamber and coupled to the collar, wherein the collar is adapted to rotate the threaded rod relative to the elongate container; and a piston disposed within the cylindrical chamber and threadingly engaged with the threaded rod, wherein the piston includes a sealing ring positioned on an end of the piston, to circumferentially seal against an inner wall of the cylindrical chamber and at least two axially aligned ribs, extending beyond the outer diameter of the sealing ring, the ribs being disposed on a side of the piston and seated against the inner wall of the cylindrical chamber.

8. The dispenser of claim 7, wherein the sealing ring is disposed about a head of the piston.

9. The dispenser of claim 7, wherein two of the ribs are disposed on opposite sides of the piston.

10. The dispenser of claim 7, wherein the ribs are equidistantly disposed about the side of the piston.

11. The dispenser of claim 7, wherein multiple ribs form groups, and the groups are equidistantly disposed about the side of the piston.

12. The dispenser of claim 7, wherein the piston includes a second sealing ring positioned on the opposite end of the piston to circumferentially seal against the inner wall of the cylindrical chamber, wherein the ribs are disposed between the two sealing rings.

13. The dispenser of claim 12, wherein the ribs extend beyond the outer diameter of the second sealing ring.

14. The dispenser of claim 7, wherein the elongate container includes two guide ribs disposed at and on opposite sides of the opening.

15. The dispenser of claim 7, wherein the collar is incorporated as part of an applicator head.

16. The dispenser of claim 7, wherein the collar is affixed to the elongate container at the opening.

17. A dispenser comprising:

an elongate container including a cylindrical chamber, the cylindrical chamber having an opening at one end of the container, wherein the elongate container includes two guide ribs disposed at and on opposite sides of the opening;

a collar affixed to the elongate container, the collar being adapted to rotate relative to the elongate container;

a threaded rod having a hollow interior, the threaded rod being axially disposed within the cylindrical chamber and coupled to the collar, wherein the collar is adapted to rotate the threaded rod relative to the elongate container; and a piston disposed within the cylindrical chamber and threadingly engaged with the threaded rod, wherein the piston includes a sealing ring positioned on an end of the piston, to circumferentially seal against an inner wall of the cylindrical chamber and at least two axially aligned ribs, extending beyond the outer diameter of the sealing ring, the ribs being disposed on a side of the piston and seated against the inner wall of the cylindrical chamber.

* * * * *

UNITED STATES PATENT AND TRADEMARK OFFICE

CERTIFICATE OF CORRECTION

PATENT NO. : 8,206,050 B2
APPLICATION NO. : 12/130321
DATED : June 26, 2012
INVENTOR(S) : David Prague It is certified that error appears in the above-identified patent and that said Letters Patent is hereby corrected as shown below:

On the Title Page:
(73), the Assignee: L'Oreal USA Products, Inc.
should read:
--(73) Assignee: L'OREAL--

Signed and Sealed this
Fifteenth Day of January, 2013

David J. Kappos
*Director of the United States Patent and Trademark Office*